United States Patent [19]

Volan

[11] 4,369,610

[45] Jan. 25, 1983

[54] EXTERNAL REVETMENT PANEL FOR BUILDINGS

[75] Inventor: Daniel Volan, Grisy les Platres, France

[73] Assignee: Luchaire S.A., Paris, France

[21] Appl. No.: 214,676

[22] Filed: Dec. 9, 1980

[30] Foreign Application Priority Data

Dec. 11, 1979 [FR] France ..... 79 30337

[51] Int. Cl.[3] ..... E04B 1/62; E04B 2/00

[52] U.S. Cl. ..... 52/509; 52/533; 52/578; 52/489

[58] Field of Search ..... 52/506, 509, 302, 303, 52/533, 534, 535, 578, 489

[56] References Cited

U.S. PATENT DOCUMENTS 4,100,711 7/1978 Skuran ..... 52/489

FOREIGN PATENT DOCUMENTS 2447489 8/1976 Fed. Rep. of Germany .
2186590 11/1974 France .
2307927 4/1975 France .

*Primary Examiner*—James L. Ridgill, Jr.
*Attorney, Agent, or Firm*—Wigman & Cohen

[57] ABSTRACT

An external revetment panel for the thermal insulation of buildings. The panel comprises a shell having upper and lower edges in parallel stepped relationship with the surface, the depth of the lower step being smaller than that of the upper step, the edge of the upper step being bent into a channel section, and the web thereof being formed with holes; gapping means provided on at least one of the stepped edges of the panel; at least one bracket fixed to the free flange of the channel section; and a layer of insulating material fixed to spacing means which are in turn secured to the internal surface of the shell.

12 Claims, 6 Drawing Figures

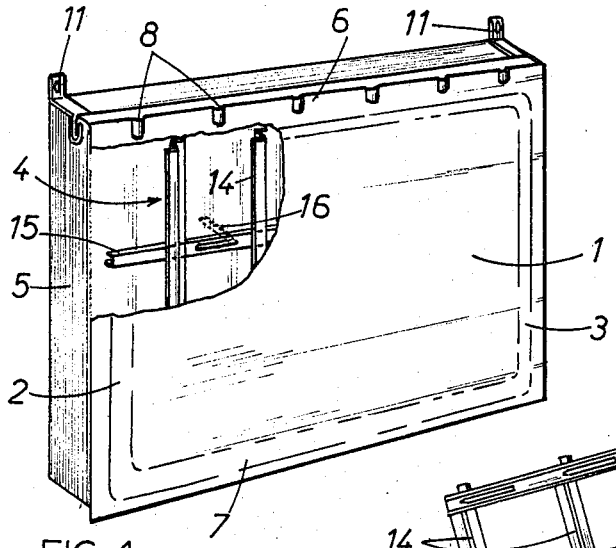
FIG.:1
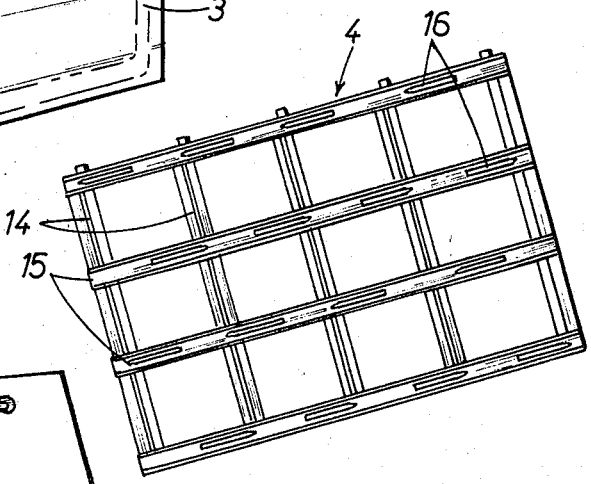
FIG.:3
FIG.:4
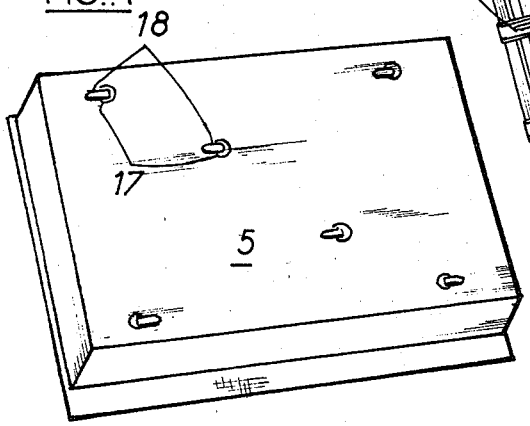
FIG.:5
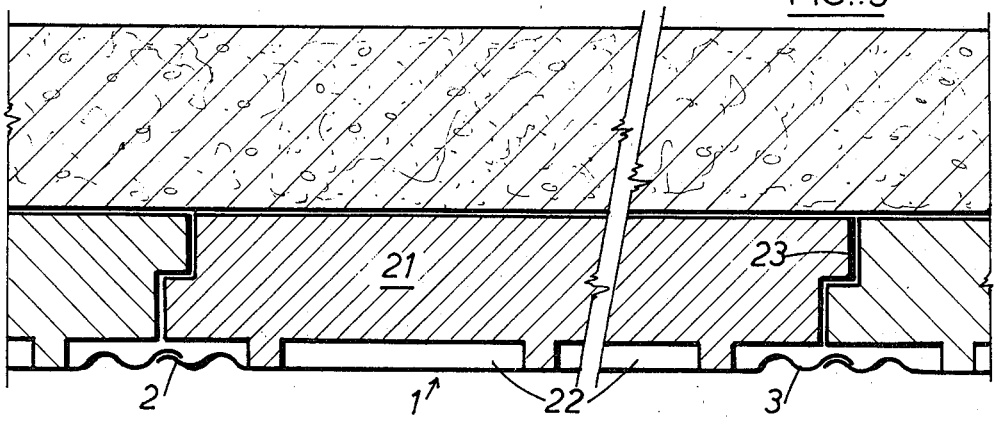

EXTERNAL REVETMENT PANEL FOR BUILDINGS

This invention relates to an external revetment panel for buildings, and more particularly to a breathing and insulating dressing panel capable of forming an unbroken facing.

The need to provide better thermal insulation for buildings has led building and insulation specialists to seek effective and inexpensive ways of reducing heat losses from existing buildings, the insulation standards of which are no longer acceptable in the present economic context.

Numerous solutions have already been experimented but have often proved difficult to apply and/or of questionable economic viability.

French Pat. No. 2.307.927 relates to an external revetment and insulation panel for buildings. It is formed by a metal shell, three sides of which bear ribs the function of which is to provide watertight covering for assembled panels. The nonribbed side is covered by or covers the panel immediately above or below. Fixed to the interior of the shell is a mattress of insulating material the compression of which is limited by cleats which are themselves secured to the shell by pins. A panel formed thus by a metal shell and a layer of insulating material is fixed to the building facade by gluing, the glue being applied onto the cleats. In order to maintain the panel in position while the glue sets, hooks are fixed to the wall and cooperate with the lower and upper edges respectively of two superimposed shells. In order to permit run-off of condensation, a net of drainage paths is provided between the insulating mattress and the shell. A projecting rib formed on the lower edge of the shell allows surface water to run off.

This form of construction has definite advantages by comparison with the previous methods involving numerous on-site operations, including laying the insulating material and then preparing the facing. On the other hand, construction of the panel is complex by reason of the use of gluing cleats which must be securely fixed to the shell. Such securing is all the more necessary in that the shell must be of light weight, implying a thin metal shell which is consequently highly flexible.

It is additionally necessary to clean the wall surface, on which the coating must be in good condition and compatible with the chemical composition of the glue.

The hooks for holding the panel in position while the glue sets remain visible on the surface of the revetment. This accessibility, particularly in pedestrian-frequented areas, could prompt their rough handling with consequent degradation of the revetment. Further, positioning the panels on the hooks frequently results in damage to the protective layer and subsequent incipient corrosion.

The present invention relates to a panel which is of a similar type to the one described precedingly but which is simpler to set since it requires no gluing to maintain it in position nor prior cleaning of the wall. Further, it is more rigid and ensures dependable circulation of air through the space included between the shell and the insulating material and elimination of condensation water without danger of the same being retained by the shell, which is especially important in order to avoid corrosion.

The description which follows with reference to the accompanying nonlimitative exemplary drawings will give a clear understanding of how the invention can be carried into practice.

In the drawings:

FIG. 1 is a perspective view with partial cutaway of a panel according to the invention;

FIG. 3 is a perspective view of a screening panel;

FIG. 4 is a back view of a panel according to this invention;

FIG. 5 is a view in horizontal section of an alternative embodiment of a panel according to the invention.

Reference to FIG. 1 shows in perspective, with partial cutaway, an embodiment of a revetment panel according to the invention.

Figure 6:
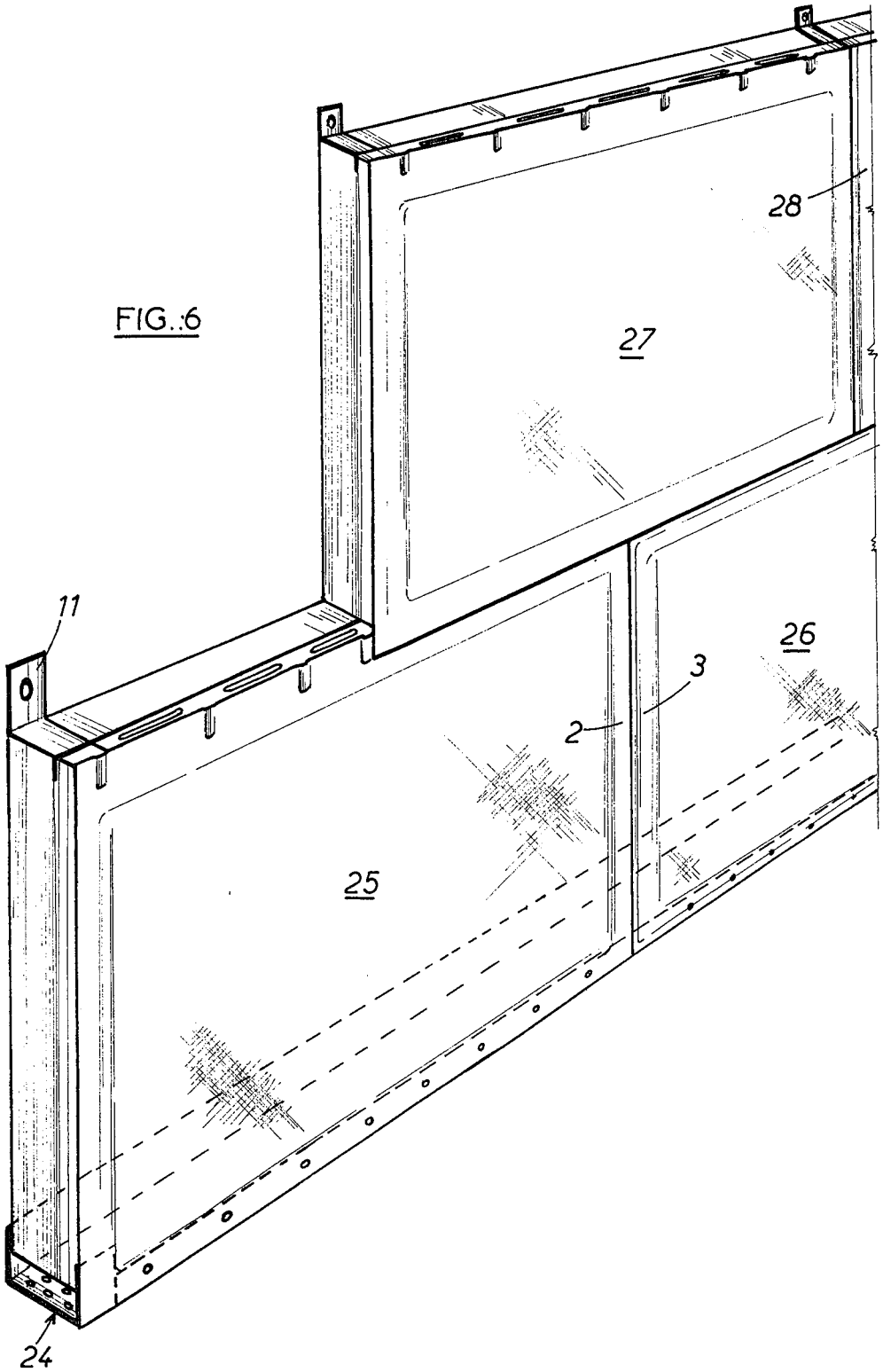
FIG. 6 is a perspective showing of assembled panels.

Such panel is formed of a plurality of elements:

a shell 1 bearing parallel ribs 2 and 3 along its vertical edges, which ribs adequately overlap, as well-known per se, the vertical edges of two adjacent panels (FIG. 6);

spacing means 4 formed by a screening panel;

a layer of insulating material 5.

Figure 2:
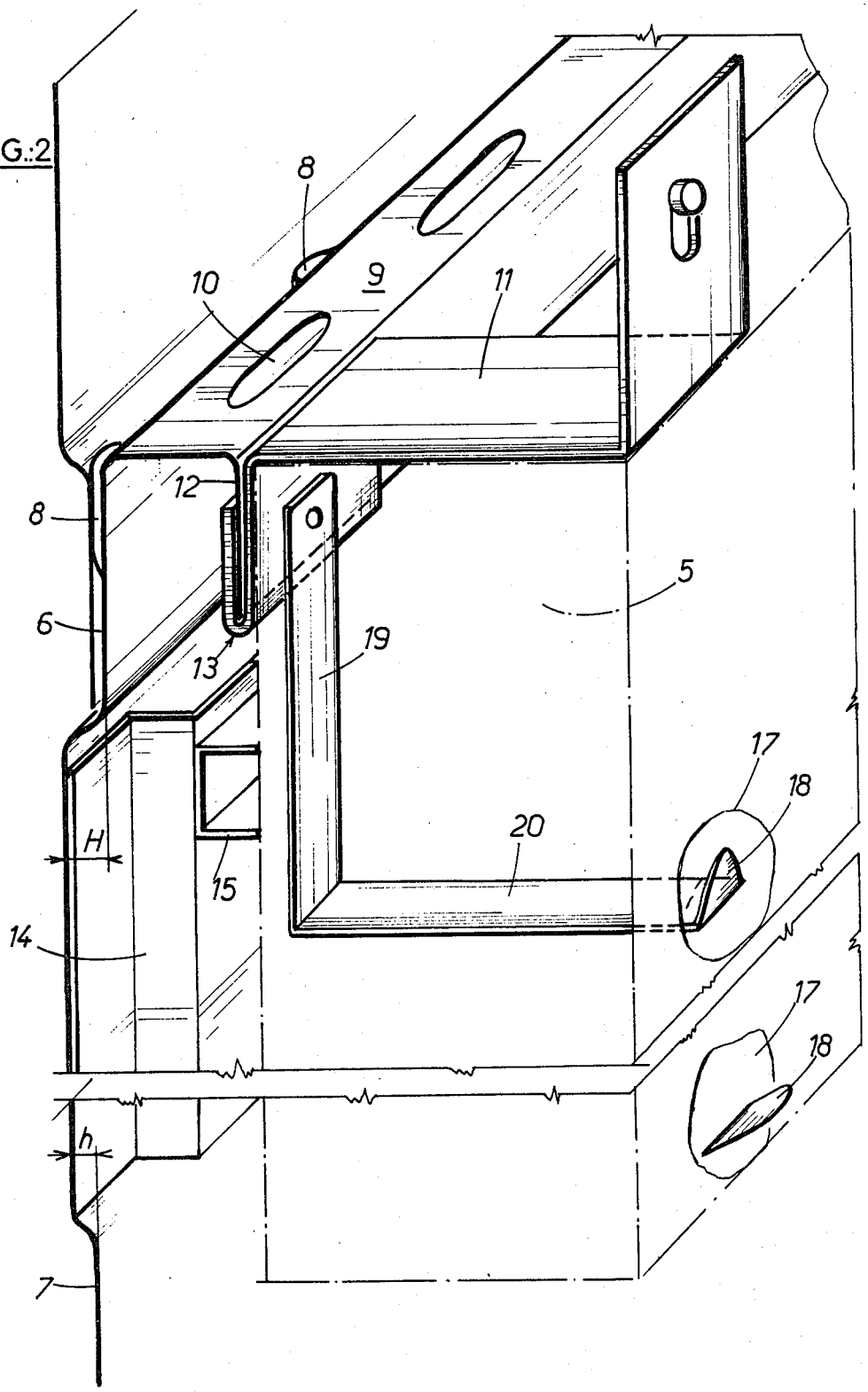
FIG. 2 is a schematic partial back view of a shell.

As shown in FIG. 2, the upper and lower edges 6 and 7 respectively of the shell are stepped in relation to the surface. The depth H of stepped portion 6 is greater than the depth h of stepped portion 7. The utility of these differences will be explained later. The edge of upper stepped portion 6 is bent into a U-shape which forms an individual skeleton for each panel. Spacing means are provided over at least one of the upper or lower stepped edges 6 and 7. In the form of embodiment shown in FIG. 2, such means are obtained by stamping, over the portion 6 proximate the base of the U-shape, bossages 8 the convex surfaces of which face the external surface of the shell. These bossages come into contact with the internal surface of the shell of the panel located immediately above and more specifically with stepped portion 7, thereby maintaining a passageway of clearly defined dimensions between and over the entire length of the panels for purposes of ventilation and condensation water run-off. The differences in depth of the stepped portions make it possible to obtain a revetment which is parallel to the wall.

Alternatively, said spacing means may be arranged along only the lower or upper edge of the shell, or over the two facing edges and may be formed by shaped, glued or welded elements.

The transverse branch 9 of the U-shaped portion is formed with holes 10 therein to permit free circulation of air and flowing of condensation water behind the shell and over the entire height of the revetement.

A panel according to this invention may be secured to the wall to be covered, as well-known per se, by nailing, sealing or otherwise fixing brackets 11. In the embodiment described and illustrated herein, the panel is secured solely by two brackets fixed to the free flange 12 of the U-shaped portion. The length of the bracket is determined according to the thickness of the insulating material required and is substantially equal thereto. In a preferred embodiment, the bracket 11 has its portion cooperating with the free flange 12 of the U-shape formed into a channel 13 which provides simple and reliable securing. Such a channel section enables the bracket to be fixed to flange 12 with a single rivet, the panel being still held in position even if the rivet should loosen or snap as a result of vibration. This fixing method leaves the surface clear of any visible fastening means and thus helps to improve the appearance of the revetment and to avert corrosion and/or undesirable tampering. The bracket lies inside the bulk of the insulating material, namely in the dry part of the revetment paneling and protected from corrosion.

The fact that the channel section of the bracket is secured by a rivet makes it easy to modify the attachment points when completion of the revetment calls merely for portions of panel. In such cases the bracket can be unrivated from the unused part of the panel and transferred to the portion thereof which is to be fitted. The shape of the bracket makes even an otherwise precarious fixing acceptable.

As shown in FIG. 3, spacing means such as a screening panel 4 is fixed over the internal surface of the shell, on the part lying between stepped portions 6 and 7.

In this embodiment, sectional members are arranged in two crosset layers 14 and 15. The sectional members of layer 14 are Z-shaped and those of layer 15 are U-shaped with shallow flanges, the web portion of each channel section being cut to form retaining tongues 16 capable of being bent into planes substantially perpendicular to the plane of the screening panel. The screening panel, which is glued or welded to the shell, receives the layer of insulating material 5 which is restrained by a number of upright tongues, as shown in FIG. 4.

In order to assist in restraining the insulating material, washers 17 may be placed over the tips of the tongues projecting from the material, thereby to prevent deterioration thereof when the ends 18 of the tongues are bent back in order to secure the layer to the screening panel.

In cases where the insulating material is in the form of a resilient fibrous mattress such as glass or rock wool and the surface of the screening panel is below that of the insulating layer, one or more upwardly and/or downwardly directed spacing stops 19 are disposed on the free flange 12 in order to prevent the insulating layer from obstructing the air circulation passage when it is installed (only one such stop is shown in the drawing). The number of stops depends on the nature of the material used. In one form of embodiment, the stop 19 includes a portion 20 bent at right angles away from the surface of the shell to provide a restraining tongue for the layer of insulating material in the same way as the tongues 16 described precedingly.

In the alternative embodiment of a panel shown in horizontal section in FIG. 5, the spacing means are formed by the insulating material itself. That face of the material 21 which is to lie adjacent the shell 1 is formed with cells 22 that intercommunicate in the vertical direction at least. The formed material is bonded to the shell and no longer requires securing tongues. Materials such as polystyrene or polyurethane are well suited to this form of embodiment.

In an alternative embodiment of the spacing means, the shell is stamped with inwardly projecting ribs, and these portions in relief may be produced for decorative purposes. The depth of stamping is such that it permits adequate spacing of the insulating material, which material is accordingly secured to the ribs.

In order to eliminate heat bridges at the places of connection of the insulating layers of the various panels, there is provided a peripheral rabbet 23 adapted to permit ready engagement of the panels with one another. FIG. 5 shows a rabbet obtained in a layer of formable material. The same rabbet could be obtained by having two insulating thicknesses fastened to the retaining tongues in a staggered arrangement.

FIG. 6 illustrates the manner of fitting the panels. Fixed to the lower part of the wall to be covered is a sectional iron 24 on which is placed a first panel 25 fixed in position by two brackets 11 (only one of which is visible in the drawing). A second panel 26 is then placed in position, the molded vertical edge 3 of which engages over the likewise molded vertical edge 2 of the first panel, and so on along the entire length to be covered. The procedure is the same for the second row of panels, which are fitted with an offset of one half-panel for example. Panels 27, 28, et al, are placed in position in the same way as those in the first tow of panels. Successive row of panels are fitted in this way over the entire height to be covered.

Different panel shapes can be used to give different aspects.

Panels according to this invention withstand bending by reason of the shell being reinforced by the spacing means, the rigidity being maintained by the U-shaped upper edge of the panel that performs the function of a frame element.

I claim:

1. An external revetment panel for buildings and more particularly a ventilated insulating revetment panel comprising in succession from the exterior to the interior a shell having parallel ribs along its vertical edges, a screening panel and insulating material, said screening panel maintaining the insulating material in spaced relationship with the shell, in which:

the shell has an upper and a lower edges in parallel stepped relationship to the surface, the depth of the lower step being smaller than the depth of the upper step, the edge of the upper step being bent into a channel section and the transverse web of the channel section having holes formed therein, gapping means provided on at least one of the stepped edges of the panel, at least one bracket fixed to the free flange of the channel section, and the insulating material fixed to spacing means which are in turn fixed to the internal surface of the shell.

2. A panel as claimed in claim 1, in which the spacing means are formed by one face of the layer of insulating material, which layer is shaped in such manner as to have surface cells which intercommunicate in the vertical direction at least.

3. A panel as claimed in claim 1, in which the spacing means are formed by bosses having their convex surfaces facing the interior of the shell.

4. A panel as claimed in claim 1, in which the insulating material bears a peripheral rabbet over at least two of the four sides.

5. A panel as claimed in claim 1, wherein the gapping means are formed by elements fast with at least one of the stepped edges.

6. A panel as claimed in claim 2, in which the gapping means are bosses formed in at least one of the stepped edges.

7. A panel as claimed in claim 1, in which the spacing means form a screening panel made up of sectional members arranged in two crossing layers, the sectional members of at least one layer having cut-out retaining tongues capable of being bent upright into planes substantially perpendicular to the plane of the screening panel.

8. A panel as claimed in claim 7, in which the layer of insulating material is secured to the screening panel by restraining tongues the ends of which are bent over onto the insulating material.

9. A panel as claimed in claim 1, in which the edge bent into a channel section bears at least one spacing stop on the free flange of the channel section.

10. A panel as claimed in claim 9, in which the spacing stop is bent at right angles, the portion thereof perpendicular to the shell forming a restraining tongue.

11. A panel as claimed in claim 1, in which the bracket fixed to the free lateral flange of the channel section bears in the cooperating portion thereof a trough section in which rests the flange of the channel section.

12. A panel as claimed in claim 11, in which the bracket at least is fixed by a rivet.

* * * * *